US005262580A

United States Patent [19]

Tanaka et al.

[11] Patent Number: 5,262,580

[45] Date of Patent: Nov. 16, 1993

[54] MUSICAL INSTRUMENT DIGITAL INTERFACE PROCESSING UNIT

[75] Inventors: Masaharu Tanaka; Shunsuke Ishida, both of Osaka, Japan

[73] Assignee: Roland Corporation, Osaka, Japan

[21] Appl. No.: 898,312

[22] Filed: Jun. 15, 1992

[30] Foreign Application Priority Data

Jan. 17, 1992 [JP] Japan ..... 4-006174

[51] Int. Cl.[5] ..... G10H 7/00

[52] U.S. Cl. ..... 84/602; 84/645

[58] Field of Search ..... 84/601, 602, 609-614, 84/622-625, 634-638, 645

[56] References Cited

U.S. PATENT DOCUMENTS 3,915,047 10/1975 Davis et al. ..... 84/645
4,412,470 11/1983 Jones ..... 84/645 X
4,991,218 2/1991 Kramer ..... 84/622 X

*Primary Examiner*—Stanley J. Witkowski
*Attorney, Agent, or Firm*—Shea & Gould

[57] ABSTRACT

A musical information digital interface processing unit is interposed between a host processor, such as a personal computer, and an electronic musical instrument for interfacing the host processor and the electronic musical instrument by converting the data format of musical information. The musical information digital interface processing unit is composed of: an input device for receiving musical information and time information linked to the musical information from the host processor; a storage device for storing the musical information and the time information received through the first input device; a first output device for sequentially sending out the musical information at a timing determined on the basis of the time information to the musical instrument and a second output device for sending out in the first data format the musical information at the timing to the host processor.

5 Claims, 6 Drawing Sheets

| STATUS | ON/OFF | |
|---|---|---|
| 9X | 1 | NOTE ON |
| AX | 0 | AFTER TOUCH |
| BX | 1 | CONTROL CHANGE |
| CX | 1 | PROGRAM CHANGE |
| DX | 0 | AFTER TOUCH |
| EX | 0 | PITCH BEND |

MODIFY PATCH

| | | | PATCH 0 | | PATCH 15 |
|---|---|---|---|---|---|
| CONTROL CHANGE | 0 | 0 | 0x7F | 0 | 0x7F |
| CONTROL CHANGE | 1 | 1 | 0x7F | 1 | 0x7F |
| | | : : : | ..... | : : : | |
| CONTROL CHANGE | 119 | 119 | 0x7F | 119 | 0x7F |
| CONTROL CHANGE | 120 | 120 | 0x7F | 120 | 0x7F |
| NOTE OFF MSB | | 121 | TABLE 0 | 121 | TABLE 15 |
| NOTE OFF LSB | | 122 | 0x7F | 122 | 0x7F |
| NOTE ON MSB | | 123 | TABLE 0 | 123 | TABLE 15 |
| NOTE ON LSB | | 124 | 0x7F | 124 | 0x7F |
| KEY PRESSURE MSB | | 125 | 0x7F | 125 | 0x7F |
| KEY PRESSURE LSB | | 126 | 0x7F | 126 | 0x7F |
| PROGRAM CHANGE | | 127 | 0x7F | 127 | 0x7F |
| CHANNEL PRESSURE | | 128 | 0x7F | 128 | 0x7F |
| PITCH BEND MSB | | 129 | 0x7F | 129 | 0x7F |
| PITCH BEND LSB | | 130 | 0x7F | 130 | 0x7F |

FIG.8

MUSICAL INSTRUMENT DIGITAL INTERFACE PROCESSING UNIT

BACKGROUND OF THE INVENTION

1. Field of the Invention

The present invention relates to a musical instrument digital interface processing unit (hereinafter referred to as "MPU") interposed between a host processor, such as a personal computer, and an electronic musical instrument for the conversion of the data format of musical instrument.

2. Description of the Prior Art

The MIDI (musical information digital interface) has widely been used as standards for controlling communication between electronic musical instruments and between an electronic musical instrument and a computer. For example, so-called computer music is played quite easily by controlling an electronic musical instrument by a personal computer. In playing computer music, an MPU is employed in converting the data format of musical information fed out by the host processor dealing with, for example, 8-bit and 16-bit parallel signals (hereinafter referred to as "first data format") into the corresponding data format suitable for controlling the electronic musical instrument (hereinafter referred to as "second data format") and vice versa.

SUMMARY OF THE INVENTION

However, problems arise in interfacing between the musical information of the first data format and that of the second data format by the conventional MPU because the conventional MPU is provided with a buffer having a relatively small capacity and its processing speed is relatively low; a musical tune of a high tempo having a large number of musical notes to be played in a unit time cannot properly be played automatically in the correct tempo. Such a problem is due principally to the host processor being a general purpose personal computer not designed specially for automatic performance and being incapable of responding to the request of the MPU for musical information.

In adding a melody to an accompaniment previously stored in the host processor while the accompaniment is being played automatically, (such, a playing mode will be referred to as "overdubbing"), the load on the host processor is increased because the host processor must control both input messages and output messages.

Accordingly, it is a first object of the present invention to provide an MPU capable of interfacing between a host processor and an electronic musical instrument so that a tune can correctly be played automatically even if the tune is of a high tempo and is a complex composition.

A second object of the present invention is to provide an MPU capable of reducing load on the host processor during overdubbing.

An MPU according to the present invention is adapted to be connected to both a host processor and a musical instrument.

An MPU in a first aspect of the present invention comprises:

(1) an input means for receiving musical information and time information linked to the musical information from the host processor;

(2) a storage means for storing the musical information and the time information received through the input means;

(3) a first output means for sequentially sending out the musical information at a timing determined on the basis of the time information to the musical instrument; and (4) a second output means for sending out the musical information at the timing to the host processor.

Desirably, the MPU further comprises (5) a filtering means for selecting predetermined pieces of musical information among the musical information to be sent out through the first output means.

An MPU in a second aspect of the present invention comprises:

(6) a first input means for receiving first musical information from the host processor;

(7) a first output means for sending out the first musical information to the musical instrument;

(8) a second input means for receiving second musical information from the musical instrument;

(9) a timing means for determining time information to be linked to the first and the second musical information by measuring a time interval of the first and the second musical information input thereto; and

(10) a third output means for sending out the first and the second musical information and the time information determined by the timing means to the host processor.

Desirably, the MPU in a second aspect of the present invention further comprises:

(11) a filtering means for selecting predetermined pieces of musical information among the first musical information to be sent out through the first output means.

An MPU in a third aspect of the present invention comprises:

(12) a first input means for receiving first musical information and time information linked to the first musical information from the host processor;

(13) a storage means for storing the first musical information and the time information received through the first input means;

(14) a third input means for receiving a third musical information without accompanying time information to be sent out to the musical instrument immediately from the host processor;

(15) a first output means for sequentially sending out the first musical information at a timing determined on the basis of the time information and sending out the third musical information when the third musical information is given thereto through the third input means to the musical instrument;

(16) a timing means for determining time information to be linked to the first and the third musical information by measuring a time interval of the first and the third musical information input thereto; and

(17) a third output means for sending out the first and the third musical information and the time information determined by the timing means to the host processor.

The MPU in the first aspect of the present invention receives the musical information and the time information (item (1)), stores the same (item (2)) and feeds out the musical information sequentially according to the time information linked thereto (item (4)). Therefore, the host processor need not feed the musical information in response to the request of the MPU, but may feed the musical information previously to the buffer of the MPU while the host processor is free and, consequently, the tune can properly be played automatically in its tempo even if the tune has a complex composition and a high tempo. However, in such automatic performance, the host processor feeds the musical information merely at random, the timing of playing is controlled according to the time information linked to the musical information by the MPU, and hence the host processor is unable to learn of the present state of playing. Accordingly, the MPU in the first aspect of the present invention gives the musical information sequentially to the musical instrument according to the time information linked to the musical information (item (3)) and, at the same time, gives the same musical information to the host processor (item (4)). The host processor is able to learn of the present state of playing from the musical information received from the MPU and is able to display the present state of playing on its display. All the musical information given to the musical instrument need not necessarily be given also to the host processor; only predetermined pieces of musical information among those given to the musical instrument are given to the host processor (item (6)) to omit the operation of the host processor for receiving unnecessary information and for selecting necessary information from the received information and to reduce the load on the host processor accordingly.

The MPU in the second aspect of the present invention, like the MPU in the first aspect of the present invention, receives the musical information (item (6)), and gives the musical information to the musical instrument (item (7)). This MPU is capable of receiving second musical information produced by an electronic musical instrument, such as an electronic keyboard instrument (item (8)) and gives the same to the host processor together with the first musical information (item (10)) after determining time information (item (9)). Accordingly, the host processor need not merge the musical information to be fed out by the host processor and the musical information given thereto, which reduces the load on the host processor greatly. Since the MPU, like the MPU in the first aspect of the present invention, gives only the predetermined pieces of musical information required by the host processor among the first musical information sequentially given to the electronic musical instrument (item (11)) to further reduce the load on the host processor.

The MPU in the third aspect of the present invention is capable of giving the musical information stored in the host processor to the electronic musical instrument, of controlling, in a real-time control mode, musical information for controlling volume and pan entered by operating the keyboard or the like of the host processor and of feeding the musical information back to the host processor for storage.

The MPU in the third aspect of the the present invention, like the MPU in the first aspect of the present invention, receives the first musical information and the time information (item (12)), stores the same temporarily in the storage means (item (13)) and feeds out the first musical information sequentially according to the time information linked thereto (item (15)). This MPU is provided with the third input means for entering the third musical information (item (14) and feeds out the third musical information entered by the third input means immediately (item (15)). Accordingly, actual playing timing is controlled by the MPU according to the time information linked to the first musical information, and volume and pan are controlled in a real-time control mode by entering the musical information for controlling volume and pan by the third input means.

The MPU determines time information corresponding to the first and the third musical information (item (16)) and feeds out the first and the third musical information and the time information (item (17)). Therefore, the host processor need not merge the first and third musical information, which reduces the load on the host processor greatly.

Thus, the MPU in the first aspect of the present invention receives and stores the musical information and the time information, and feeds out the musical information sequentially according to the time information. Accordingly, the host processor need not feed the musical information in response to the request of the MPU for the musical information and may feed the musical information previously to the buffer of the MPU while the host processor is free and, consequently, the tune can properly be played automatically in its tempo even if the tune has a complex composition and a high tempo. Furthermore, since this MPU feeds out the musical information sequentially according to the time information linked to the same musical information, the host processor need not feed out the musical information in response to the request of the MPU for the musical information and may previously feed the musical information to the buffer of the MPU while the host processor is free. Accordingly, a tune having a complex composition and a high tempo can properly be played automatically in its tempo. Still further, since this MPU feeds out the musical information sequentially according to the time information linked to the musical information to the host processor, the host processor is able to learn the present state of playing from the received musical information and to display the present state of playing on its display.

The MPU in the second aspect of the present invention determines the time information, and feeds out the first and the second musical information and the time information. Accordingly, the host processor need not merge the output musical information thereof and the input musical information, which reduces the load on the host processor greatly.

The MPU in the third aspect of the present invention is provided with the third input means for entering the third musical information and feeds out the third musical information entered by the third input means immediately. Accordingly, the actual playing timing is controlled by the MPU according to the time information linked to the first musical information, and volume and pan can be controlled in a real-time control mode by the musical information for controlling volume and pan entered by the third input means.

Furthermore, since this MPU determines the time information corresponding to the first and the third musical information and feeds out the first and the third musical information and the time information, the host processor need not merge the first and third musical information which reduces the load on the host processor greatly.

BRIEF DESCRIPTION OF THE DRAWINGS

FIG. 8 is a view of a modify patch for modification; and

DESCRIPTION OF THE PREFERRED EMBODIMENTS

An MPU in a preferred embodiment according to the present invention having all the components of the MPUs in the first, second and third aspects of the present invention will be described hereinafter.

Figure 1:
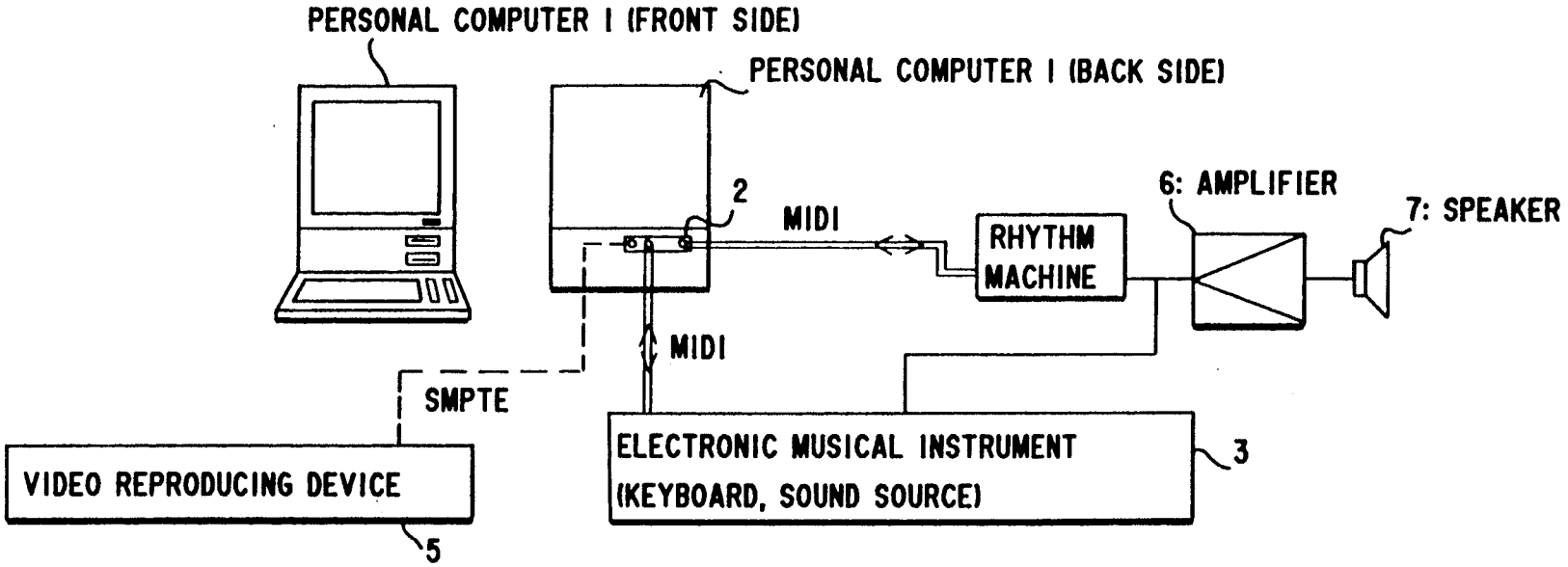
FIG. 1 is a block diagram of a system including an MPU in a preferred embodiment according to the present invention.

Referring to FIG. 1, showing a system including the MPU, coded musical scores are stored in a personal computer 1, i.e., a host processor. An MPU 2 embodying the present invention is inserted through a slot formed on the back surface of the personal computer 1 in the personal computer 1 so as to be connected to the bus of the personal computer 1. The MPU is capable of converting musical information given thereto into a musical instrument digital interface (MIDI) format and of providing the same.

An electronic musical instrument 3 connected to the MPU 2 by the MIDI device is provided with a sound source and a keyboard. The musical information fed out by the personal computer 1 is converted into the MIDI format and is applied to the electronic musical instrument 3, and then, the electronic musical instrument 3 makes the sound source generate audio signals on the basis of the MIDI format signals The audio signals are amplified by an amplifier 6, and then a speaker 7 converts the amplified audio signals into sound. When the keyboard of the electronic musical instrument is operated to provide musical information the musical information is sent to the MPU 2 as a MIDI format signal. Upon the reception of the musical information, the MPU 2 transfers the musical information together with time information to the personal computer 1. The system is provided with a rhythm machine 4, which is connected by the MIDI device to the MPU 2. The rhythm machine 4 plays the previously programmed rhythm automatically. The MPU 2 is capable of controlling the electronic musical instrument for playing music in synchronism with a timing signal provided by the rhythm machine 4.

A video reproducing device 5 is connected to the system. Generally, the video device is capable of transmitting and receiving a time code for synchronization. The MPU also is capable of transmitting and receiving a time code for synchronization.

Figure 2:
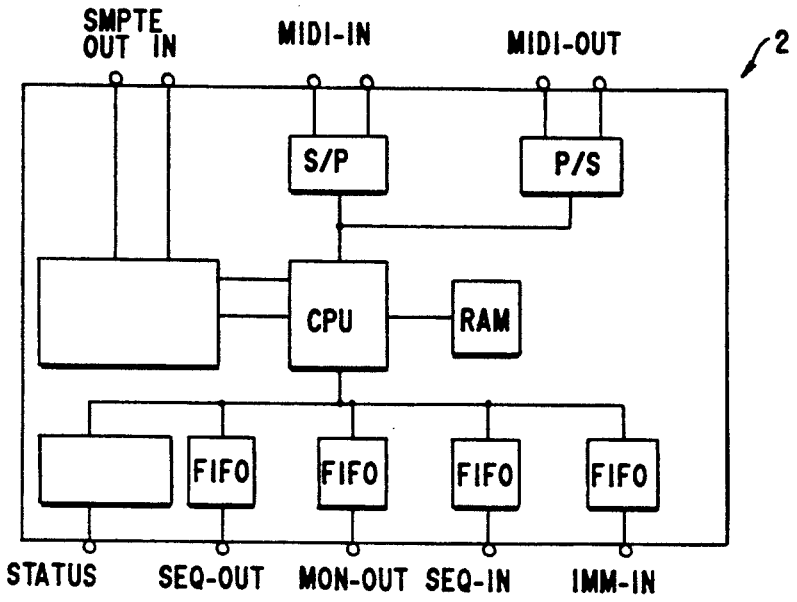
FIG. 2 is a block diagram of the MPU included in the system of FIG. 1.

FIG. 2 is a block diagram of the MPU 2. Although the MIDI device of the MPU 2 shown as FIG. 1 is shown in a bidirectional MIDI device and has two channels, FIG. 2 shows the MPU 2 in an MPU having a MIDI input port MIDI_IN and a MIDI output port MIDI_OUT each of one channel for simplicity.

The IMM_IN port, SEQ_IN port, MON_OUT port, SEQ_OUT port and STATUS port of the MPU 2 are connected to the personal computer 1 (FIG. 1). Each of these ports excluding the STATUS port is provided with a 32-word FIFO (first-in first-out) register. A status register connected to the STATUS port is a group of flags accessible by both the personal computer 1 and the MPU 2. When data is written in the FIFO register of each port, the flag corresponding to the FIFO register is set. When the data is read from each FIFO register, the flag corresponding to the FIFO register is reset. Thus, any state of the FIFO register can be obtained from a respective one of the flags of the status register.

The CPU of the MPU 2 monitors the flags corresponding to the FIFO registers. When a message written in the FIFO register connected to, for example, the IMM_IN port is detected, the CPU transfers the message immediately to a parallel-serial converter (P/S converter) connected to the MIDI_OUT.

The MIDI_IN port and the MIDI_OUT port are connected to the electronic musical instrument 3 and the rhythm machine 4. A SMPTE IN&OUT port is connected to the video reproducing device 5.

The functions of these ports will be described hereinafter.

(a) IMM_IN Port: The IMM_IN port, which corresponds to the third input means, is a port for receiving instructions to be controlled immediately. When a message applied to the IMM_IN port is written in the FIFO register, the CPU reads the message immediately and applies the same to the MIDI_OUT port. For example, in changing volume, pan or timbre for a channel while the electronic musical instrument is playing a tune automatically, a message requesting the change of volume, pan or timbre must be transmitted immediately. Such a message is applied to the IMM_IN port. When a control instruction for controlling the MPU 2, such as a tempo change instruction, is given, the MPU 2 responds to the control instruction and, if the control instruction need not be transmitted outside, the control instruction is not sent out.

(b) SEQ_IN Port: The SEQ_IN port, which corresponds to the input means and the first input means, is a port to which sequence data for automatic performance accompanying with time information is applied. The sequence data for automatic performance stored on, for example, a floppy disk is loaded on the personal computer 1, and then the personal computer 1 applies the sequence data to the SEQ_IN port. Then, the sequence data is stored temporarily in the buffer P (FIG. 3) of the RAM and the same is sent out under time management.

(c) SEQ_OUT Port: A message applied to the MIDI_IN port and converted into a parallel signal by a serial-parallel converter (S/P converter) or a message applied to the IMM_IN port and additionally provided with time information is sent out through the SEQ_OUT port.

(d) MON_OUT Port: The MON OUT port, which corresponds to the second output means, is a port through which data being sent out through the MIDI_OUT port is fed back to the personal computer 1.

(e) MIDI_IN Port: The MID_IN port, which corresponds to the second input means, is a port through which MIDI format signals produced in accordance with the MIDI format standard are received. The MIDI signals are serial signals having a word length of eight bits. The input MIDI signal is converted into a parallel signal by the serial-parallel converter (S/P converter) and interruption occurs in the CPU.

(f) MIDI_OUT Port: The MIDI_OUT port corresponds to the first output means. In sending out a MIDI signal, the parallel-serial converter (P/S converter)

converts a message provided by the CPU into a serial signal and applies the same to the MIDI_OUT port.

The messages applied to the IMM_IN port and the SEQ-IN port are sent out through the MIDI_OUT port. Predetermined messages, which are selected by a filter which will be described later, among the output messages are given again through the SEQ_OUT port to the personal computer 1.

(g) SMPTE IN&OUT Port: The SMPTE IN&OUT port is an additional port. A Society of Motion Picture and Television Engineers (SMPTE) format code. is a time code, which is used widely for synchronizing video equipment. A time code, i.e., a synchronizing serial signal, applied to the SMPTE_IN terminal is converted into a predetermined time information by a time processor and the time information is sent to the CPU. Predetermined time information or a time code can be produced by an instruction given by the CPU and the predetermined time information or the time code can be sent out through the SMPTE_OUT terminal.

(h) STATUS Port: The personal computer 1 is able to access the status register through the STATUS port.

Data for automatic performance applied to the SEQ_IN port consists of three areas divided by four identification data enclosed with brackets as will be described hereinafter.

[Data Begin]: An identification data indicating the head of a tune

Preplaying Area: A MIDI output message, such as a timbre parameter, is stored in the preplaying area before starting the sequence. Upon the reception of the MIDI output message, the MPU sends out the same immediately.

[Song Begin]: An identification data indicating the start of the sequence

Play Area: Messages stored in the playing area are sent out according to the time information and tempo information. Each message is stored in combination with time data (time information) representing a time interval between the same message and the succeeding message.

[Song End]: An identification data indicating the end of the sequence

Postplaying Area: A message to be sent out after the end of the sequence is stored in the postplaying area.

[Data End]: An identification data indicating the last tune data

Automatic performance is carried out by using the automatic performance data thus constructed for automatic performance in a first playing mode in which the tune is played automatically in a tempo set by the MPU or in a second playing mode in which the tune is played automatically in synchronism with the performance of another automatic musical instrument, such as the rhythm machine 4 (FIG. 1).

The tempo information for the first playing mode is incorporated previously into the automatic performance data or the tempo information is set by the operator by operating the keyboard or the like of the personal computer 1. The tempo information set by the operator is transferred from the personal computer 1 to the MPU 2. Then, the CPU sends information based on the tempo information to the time processor, and the time processor produces a clock signal (tick interrupt signal) of a period corresponding to the tempo on the basis of the information. A program (FIG. 6), which will be described later, is executed in synchronism with the clock signal.

In the second playing mode, automatic performance is carried out in synchronism with the start and clock signals of the MIDI device as applied to the MIDI_IN port.

During automatic performance, the MPU 2 carries out the following procedures.

Figure 3:
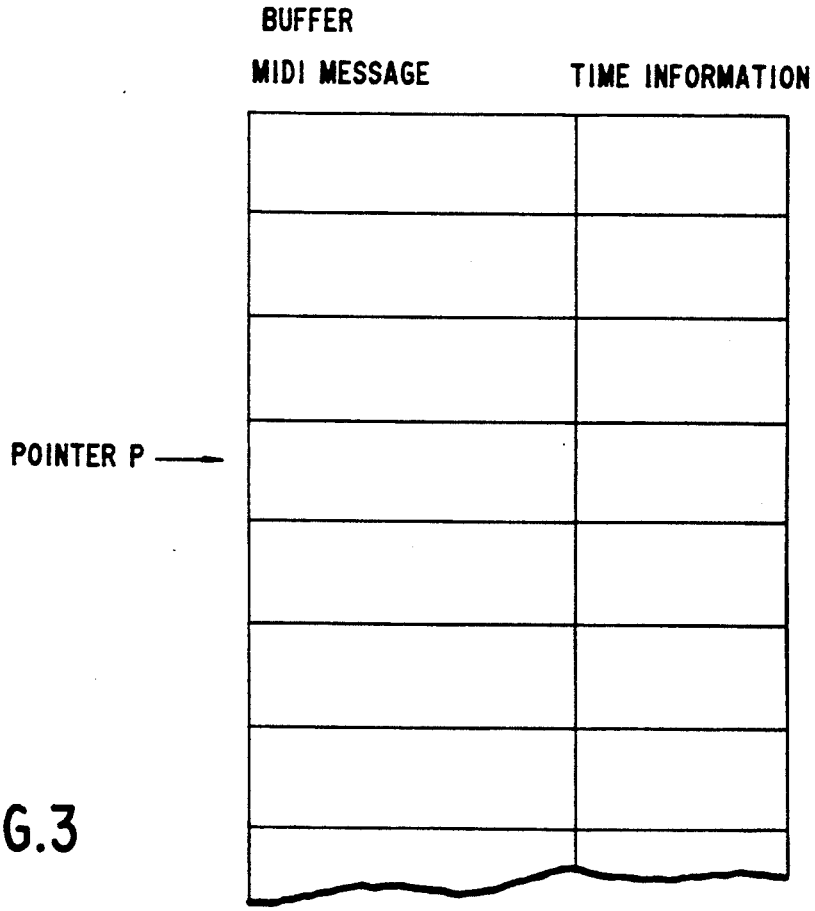
FIG. 3 is a view showing the configuration of a buffer P included in a RAM employed in the MPU.
Figure 4:
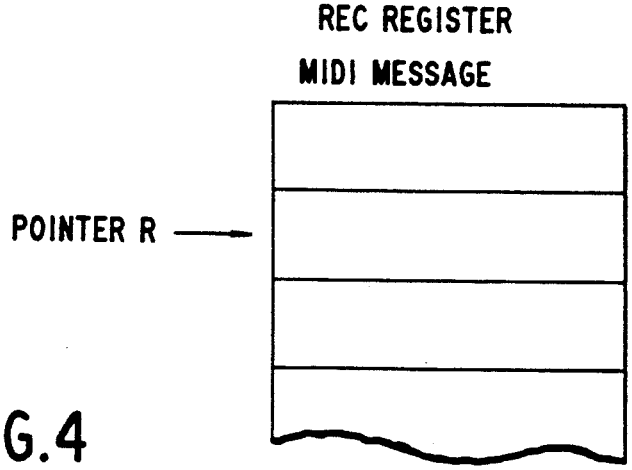
FIG. 4 is a view showing the configuration of a REC register included in the RAM employed in the MPU.

FIGS. 3 and 4 show the buffer P of the RAM, and the REC register to be used for carrying out the procedures by the MPU 2.

(a) Data Reception

The CPU monitors the status register continuously to detect the reception of data at the SEQ_IN port. Data applied to the SEQ_IN port is stored temporarily in the buffer P for the following procedure.

1) Data successive to the identification data [Data Begin] is written sequentially in the P/S converter for MIDI output before starting automatic performance.

2) The output of data after the identification data [Song Begin] is time-managed to the tempo.

3) Data between the identification data [Song End] and [Data End] are sent out sequentially after the completion of automatic performance.

4) Message applied to the IMM_IN port are sent out immediately without temporarily storing in the buffer P. The messages are processed by a filter and the like (in this specification, a channel translator, a filter and a modifier are designated inclusively as filters). A filtered link message is stored in the REC register (FIG. 4).

When a message requesting the start of automatic performance is received, the MIDI message at an address in the buffer P indicated by a read pointer P is sent out and the time information is stored in the register TSP, not shown. The time processor generates tick interrupt signals at time intervals corresponding to the tempo.

The term "time base" will now be explained. Time base is the number of clock pulses for one quarter note. Accordingly, time resolution is higher and a tune is played more smoothly when the time base is greater. Recently, the sound quality of the electronic musical instrument has been improved and the capability in fine adjustment of sound generating timing has become essential to the electronic musical instrument. Therefore, a time base of 480 or 960 has been used.

If, for example, a time base of 480 is used, 120 quarter notes must be played in one minute when the tempo is 120, time shared to one quarter note is 0.5 sec (500 msec), and the period of the reference clock signal is $500/480=1.0417$ msec. Thus, a tick interrupt signal is generated every 1.0417 msec.

Upon the conversion of 8-bit serial data into parallel data by the S/P converter, an interrupt signal is generated to interrupt the operation of the CPU, and then the CPU receives the parallel data. MIDI format signals include 1-byte, 2-byte and 3-byte messages. The CPU decides musical information to be stored among the messages and stores the musical information in the REC register, and then a pointer R is advanced. For example, a MIDI clock (F8H) is not stored and sent out immediately through the MIDI_OUT port. If necessary, the reference clock signal for automatic performance is corrected on the basis of its timing. On the other hand, when there is no tune, the MIDI clock signal is stored temporarily and the pointer R is advanced.

Figure 5:
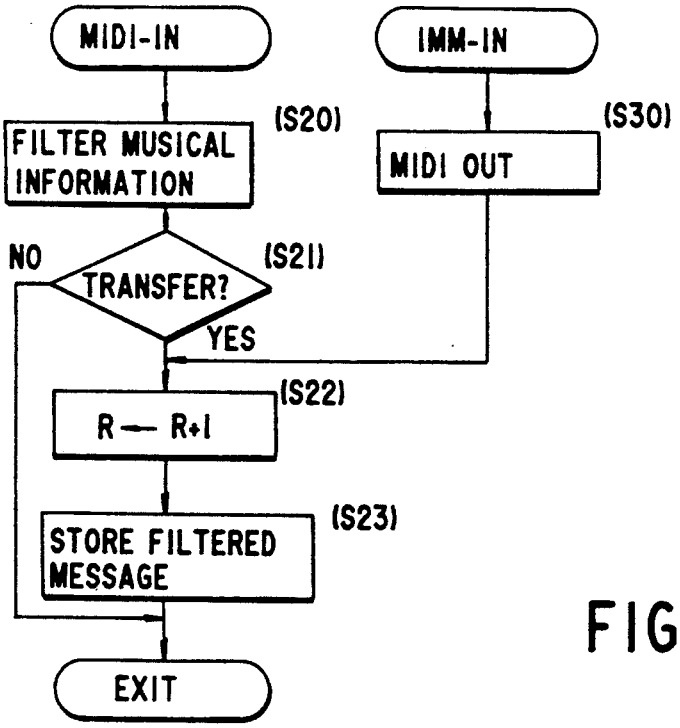
FIG. 5 is a flow chart of a routine for temporarily storing a MIDI input.

FIG. 5 shows a routine for temporarily storing a MIDI format input.

The MIDI device constructs one word by one to three bytes. Ordinarily, the S/P converter requests an interrupt every time eight bits (one byte) is received. In the following description, it is assumed for the sake of convenience that the routine is executed when one word is received. A message is filtered by a MIDI_IN filter and the pointer R of the REC register is incremented in step S20 and the filtered message is stored at an address corresponding to the pointer R in step S23. If the message is determined not to be transferred in step S21, the routine is ended.

An instruction to change volume or pan provided by the personal computer 1 is applied to the IMM_IN port, and then the operation of the CPU is interrupted. If the input instruction requires the control of the sound source, the input instruction is sent out immediately in step S30 and, at the same time, the pointer R of the REC register is incremented in step S22 and the input instruction is stored at an address indicated by the pointer R in step S23. If the input instruction is, for example, an instruction to control the MPU, such as an instruction requiring the change of the tempo, the status of the MPU is changed.

(b) TICK INTERRUPT PROCESS

Figure 6:
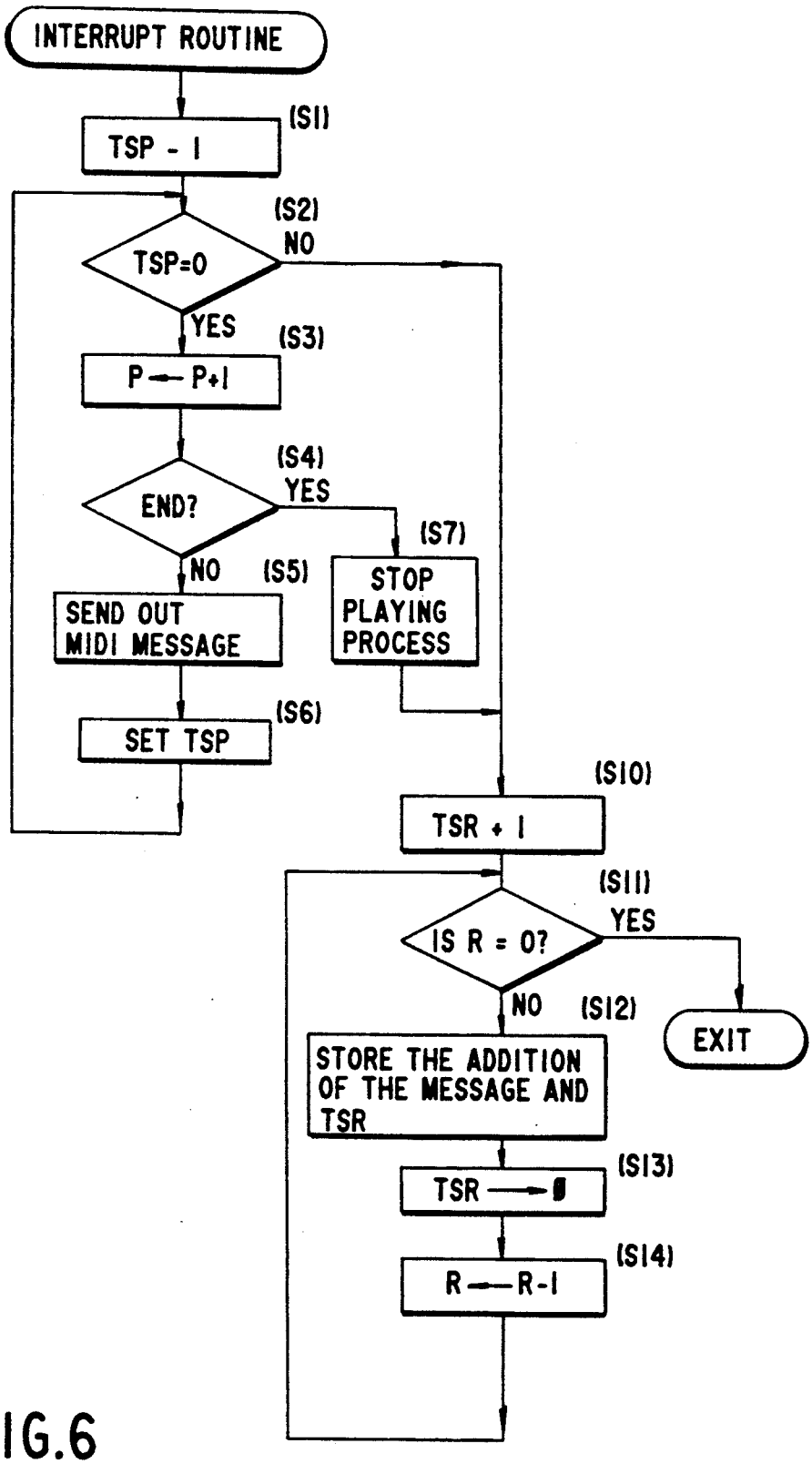
FIG. 6 is a flow chart of a routine to be started by a tick interrupt.

FIG. 6 shows a program to be started by a tick interrupt signal. In FIG. 6, steps S1 to S7 are those of a playing process and steps S10 to S14 are those of a recording process.

(1) Play Process

When an interrupt occurs, the contents of the register TSP is decremented in step S1, and a query is made in step S2 to see if the contents of the register TSP is zero. If the response in step S2 is affirmative, the pointer P (FIG. 3) is advanced in step S3 and a MIDI format message stored at an address indicated by the pointer P is sent out in step S5. A message filtered by a MON filter is applied to the MON_OUT port. At the same time, a message filtered by a LINK filter is stored in the REC register. The filters will be described later. In step S6, time information is stored in the register TSP.

If it is decided in step S4 that the contents of data indicated by the address is the end of a tune, a playing end process is executed in step S7.

If the keyboard is operated to automatic performance, a MIDI message produced by operating the keyboard is applied to the MIDI_IN port. Since the electronic musical instrument 3 employed in this embodiment has a sound source, the sound source generates musical sound when its keyboard is operated. If another sound source is to be controlled for sound generation by the MIDI message given to the MPU, an output appears also at the MIDI_OUT port.

(2) The contents of a TSR is incremented in step S10 and, if the response in step S11 is affirmative, i.e., if there is no message to be sent to the host processor and the pointer R of the REC register is zero, the routine is ended. If a message is stored in the REC register and hence the response in step S11 is negative, i.e., the pointer R is not zero, data produced by adding the contents of the TSR, i.e., time information, to the message stored in the REC register is stored in an output buffer in step S12, the TSR is cleared in step S13, the pointer R is decremented in step S14, and then the routine returns to step S11.

(c) Filters

In transferring messages, the messages can be subjected to different channel translation, filtering and modification.

Message transfer occurs when a message applied to the MIDI_IN port is sent out through the MIDI_OUT port or the SEQ_OUT port, when a message applied to the IMM_IN port is sent out through the MON_OUT port or the MIDI_OUT port, and when a message applied to the SEQ_IN port and stored in the buffer is sent out after time adjustment through the MIDI_OUT port or the MON_OUT port or when the message is transferred to the REC register.

(1) MIDI Channel Conversion

The MIDI format standard specifies sixteen channels. The MPU 2 has two input terminals and two output terminals. One of the two terminals deals with channels 0 to 15 and the other deals with channels 16 to 32. Suppose that the two terminals are a terminal A and a terminal B. Then, the channel 1 applied to the input terminal A is handled as "1" within the interface. The channel 1 applied to the input terminal B is handled as "17" (16+1) within the interface. Channel translation is achieved to translate the channel of an input message with reference to a table tabulating the number of output channels for each input channel.

(2) Filter

The first byte of a MIDI message is a status byte. The filter determines according to the status whether the MIDI message is to be transferred or whether the MIDI message is not to be transferred.

Figures 7, 9:
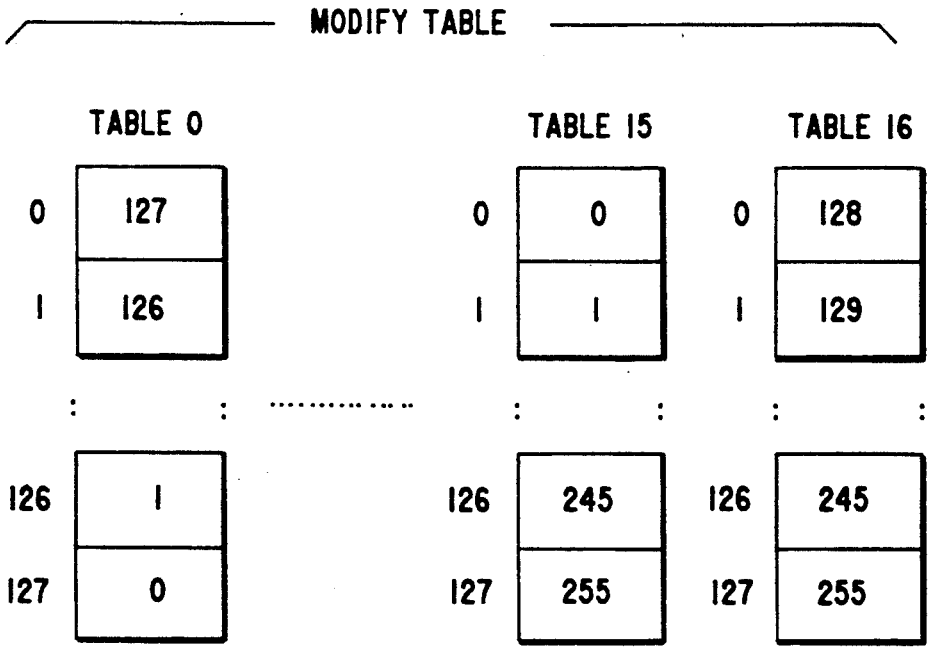
FIG. 7 is a view of a filter.
FIG. 9 is a view of a modify table for modification.

FIG. 7 shows a filter by way of example. In FIG. 7, the letter X represents an optional value.

As shown in FIG. 7, "9X" represents a status 'NOTE ON'. Since the flag is set to "1", a message 'NOTE ON' is transferred through the filter. Similarly, 'AX' represents a status 'AFTER TOUCH'. Since the flag is set to "0", the message 'AFTER TOUCH' is intercepted by the filter and not transferred.

(3) Modification

For example, NOTE ON data includes a value specifying a volume. However, the volume of sound actually generated by the electronic musical instrument corresponding to the value is dependent on the type of the electronic musical instrument and the maker of the electronic musical instrument. Accordingly, in exchanging data between the MPU 2 and an external electronic musical instrument, the value added to the MIDI message must be changed. The change of the value for such a purpose is known as modification. The MPU 2 is capable of modifying function.

FIGS. 8 and 9 are tables prepared for modification.

As shown in FIG. 8, the table has sixteen modify patches denoted by Patch 0 to Patch 15. Furthermore, seventeen modify tables denoted by Table 0 to Table 16 as shown in FIG. 9 are prepared.

The modify patches Patch 0 to Patch 16 are assigned respectively to combinations of the input and output ports of the MPU. For example, the Patch 0 is assigned to a message applied to the MIDI_IN port and to be sent out through the MIDI_OUT port.

Suppose that the Patch 0 is selected. 'OX7F' is stored at an address 0 corresponding to the message of Control Change 0 specifying a bank MSB. 'OX7F' indicates that any modification need not be made. Accordingly, the message Control change 0 applied to the MIDI_IN port is sent out through the MIDI_OUT port without being subjected to modification.

'Table 0' is stored at the address 123 of the Patch 0 corresponding to the most significant byte of note on data (Note ON MSB). Therefore, reference is made to the Table 0 among the seventeen modify tables Table 0 to Table 16 and, if the most significant byte (MSB) represents a value '1', the value '1' is replaced with a value '126' 'OX7F' is recorded at an address 124 corresponding to the least significant byte of the Note ON data (Note ON LSB), and hence the least significant byte of the Note ON data is not changed. Accordingly, the Note ON data applied to the MIDI IN port is sent out through the MIDI_OUT port after the most significant byte of the Note ON data has been changed from '1' to '126'. Values not smaller than '128' in the modify tables shown in FIG. 9 indicate that no output is provided.

What is claimed is:

1. A musical instrument digital interface (MIDI) adapted to be connected with a host processor and a musical instrument, said MIDI comprising:

an input means for receiving musical information and the information linked to the musical information from the host processor;

a storage means for storing the musical information and the time information received through the input means;

a first output means for sequentially sending out the musical information to the musical instrument at a timing determined on the basis of the received time information; and a second output means for sending out the musical information at the determined timing to the host processor.

2. A musical instrument digital interface (MIDI) according to claim 1, wherein the MIDI further comprises a filtering means for selecting predetermined pieces of musical information among the musical information to be sent out through the first output means.

3. A musical instrument digital interface (MIDI) adapted to be connected with a host processor and a musical instrument, said unit MIDI comprising:

input means for receiving first musical information from the host processor;

a first output means for sending out the first musical information to the musical instrument;

a second input means for receiving second musical information from the musical instrument;

a timing means for determining time information to be linked to the first and the second musical information by measuring a time interval of the first and the second musical information input thereto; and a third output means for sending out the first and the second musical information and the time information determined by the timing means to the host processor.

4. A musical instrument digital interface (MIDI) according to claim 3, wherein the MIDI further comprises a filtering means for selecting predetermined pieces of musical information among the first musical information to be sent out through the first output means.

5. A musical instrument digital interface (MIDI) adapted to be connected with a host processor and a musical instrument, said MIDI comprising:

a first input means for receiving first musical information ad tie information linked to the first musical information from the host processor;

a storage means for storing the first musical information and the time information received though the fist input means;

a third input means for receiving third musical information without accompany time information to be sent out to the musical instrument immediately from the host processor;

a first output means for sequentially sending out to the musical instrument the first musical information at a timing determined on the basis of the time information and sending out the third musical information when the third musical information is given thereto through the third input means;

a timing means for determining time information to be linked to the first and the third musical information by measuring a time interval of the first and the third musical information input thereto; and a third output means for sending out the first and the third musical information and the time information determined by the timing means for the host processor.

* * * * *